US008388087B2

(12) United States Patent
Matsushita et al.

(10) Patent No.: US 8,388,087 B2
(45) Date of Patent: Mar. 5, 2013

(54) LIQUID EJECTING APPARATUS AND METHOD OF CONTROLLING SAME

(75) Inventors: Junichiro Matsushita, Matsumoto (JP); Naoki Sudo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 84 days.

(21) Appl. No.: 13/159,301

(22) Filed: Jun. 13, 2011

(65) Prior Publication Data

US 2011/0316916 A1 Dec. 29, 2011

(30) Foreign Application Priority Data

Jun. 24, 2010 (JP) ..... 2010-143788

(51) Int. Cl.
*B41J 29/38* (2006.01)
*B41J 29/393* (2006.01)

(52) U.S. Cl. ..... 347/10; 347/19

(58) Field of Classification Search ..... 347/9–12, 347/19, 20, 40
See application file for complete search history.

(56) References Cited

U.S. PATENT DOCUMENTS 7,484,821 B2 * 2/2009 Sudo et al. ..... 347/13
7,645,016 B2 * 1/2010 Sato et al. ..... 347/19

FOREIGN PATENT DOCUMENTS

JP 2007261205 10/2011

* cited by examiner

*Primary Examiner* — An Do
(74) *Attorney, Agent, or Firm* — Workman Nydegger

(57) ABSTRACT

A liquid ejecting apparatus includes a recording head that has a first column of nozzles, in which nozzles that eject dye ink are provided in line in a sub-scanning direction intersecting a main scanning direction of the recording head and recording paper, and a second column of nozzles, in which nozzles that eject pigment ink are provided in line in parallel to the first column of nozzles, which are disposed side by side in the main scanning direction. The liquid ejecting apparatus also includes a control section that adjusts an ejection amount of at least one of the dye ink and the pigment ink by changing a driving signal in accordance with the landing sequence of the dye ink and the pigment ink on the recording paper.

10 Claims, 7 Drawing Sheets

LIQUID EJECTING APPARATUS AND METHOD OF CONTROLLING SAME

CROSS-REFERENCE TO RELATED APPLICATION

This application claims priority to Japanese Patent Application No: 2010-143788, filed on Jun. 24, 2010, which is expressly incorporated by reference herein in its entirety.

BACKGROUND

1. Technical Field

Embodiments of the present invention relate to a liquid ejecting apparatus, such as an inkjet type printer, that is provided with a liquid ejecting head that ejects liquid in a pressure chamber from a nozzle by providing pressure fluctuations to the pressure chamber that communicates with the nozzle, and to a method of controlling such a liquid ejecting apparatus.

2. Related Art

A liquid ejecting apparatus is an apparatus that is provided with a liquid ejecting head that is capable of ejecting (discharging) liquid and ejects various liquids from the liquid ejecting head. A representative example of the liquid ejecting apparatus is an image recording apparatus, such as an ink jet type printer (hereinafter simply referred to as a printer) that is provided with an ink jet type recording head (hereinafter simply referred to as a recording head) as a liquid ejecting head and performs recording of an image or the like by ejecting and landing ink in the form of a liquid droplet from nozzles of the recording head onto a recording medium (ejection target) such as recording paper. Also, in recent years, the liquid ejecting apparatus has been applied to various manufacturing apparatuses without being limited to the image recording apparatus. For example, in an apparatus for manufacturing a display such as a liquid crystal display, a plasma display, an organic EL (Electro Luminescence) display, or an FED (surface-emitting display), a liquid ejecting apparatus is used to eject various liquid materials, such as a color material or an electrode onto a pixel formation region, an electrode formation region, or the like.

Certain printers have a recording head in which a column of nozzles that eject dye-based ink is disposed side by side in a main scanning direction with a column of nozzles for pigment-based ink. The nozzles in each column of nozzles are provided in line in a direction intersecting the main scanning direction. Moreover, the dye-based ink includes dye in a color material and the pigment-based ink includes pigment in a color material.

In a printer configured in this manner, if an image or the like is recorded or printed on a recording medium, in particular, recording paper while making the recording head perform reciprocating scanning with respect to the recording paper, the landing sequence of the dye-based ink and the pigment-based ink in the recording paper differs in a forward path and a return path in a scanning direction. For this reason, if the dye ink and the pigment ink land in an overlapping manner in the recording paper, there is a fear that a recorded image will be blurred due to a difference in the paper infiltration amount between the inks or interference between the inks. In particular, in a case where different colors are mixed into each other due to oozing, there is a fear that the image quality of a recorded image will be deteriorated.

In order to cope with such a problem, a printer has been proposed that causes dye-based ink to land on the recording medium prior to pigment-based ink, regardless of the scanning direction. A printer of this type has a set of columns of nozzles, in which a column of nozzles for the pigment-based ink is disposed on the downstream side in a scanning direction of a column of nozzles for the dye-based ink, at each of both sides with the center in the scanning direction of the recording head interposed therebetween. Accordingly, the printer can reduce density unevenness (or color unevenness) due to a difference in infiltration rate when inks that include different color materials land on the recording medium (refer to JP-A-2007-261205, for example).

However, in the printer having the set of columns of nozzles at each of both sides with the center in the scanning direction of the recording head interposed therebetween, as described above, there are disadvantages. For example, an increase in size of the printer is caused by not only an increase in the number of columns of nozzles, but also by a corresponding increase in the number of pressure chambers communicating with the respective nozzles, pressure generation sections varying the volumes of the pressure chambers, or the like. Moreover, the configuration of such a printer is complicated.

SUMMARY

In general, example embodiments of the invention relate to a liquid ejecting apparatus having a simple configuration and a method of controlling same that reduce density unevenness when liquids that include different color materials land on a landing target.

According to a first embodiment of the invention, a liquid ejecting apparatus includes: a liquid ejecting head including a first nozzle group having nozzles arranged in line in a direction intersecting a movement direction of the liquid ejecting head relative to a landing target, each of the nozzles in the first group of nozzles being configured to eject a first liquid that includes a dye-based color material on to a landing target, and a second nozzle group having nozzles arranged in line in parallel to the first nozzle group, each of the nozzles in the second group of nozzles being configured to eject a second liquid that includes a pigment-based color material on to a landing target. The liquid ejecting apparatus also includes a driving signal generation section configured to generate a driving signal that includes one or more driving pulses for driving pressure generation sections corresponding to the nozzles in the first and second nozzle groups, the pressure generation sections being configured to cause ejection of ink from the nozzles in response to being driven by the driving signal by varying the volume of pressure chambers corresponding to and in communication with the nozzles; a scanning mechanism configured to move the landing target and the liquid ejecting head relative to each other. The apparatus further includes an adjustment section configured to adjust an ejection weight of at least one of the first liquid and the second liquid by changing the driving signal in accordance with the landing sequence of the first liquid and the second liquid on the landing target.

According to the configuration of the above first embodiment, by adjusting the ejection weight of at least one of the first liquid and the second liquid by changing the driving signal in accordance with the landing sequence of the first liquid and the second liquid on the landing target, even if the landing sequence of liquids that include different color materials differs in a forward path and a return path in the relative movement direction, density unevenness caused by a difference in infiltration rate between liquids into the landing target can be reduced with a simple configuration, so that deterioration of the image quality of an image or the like formed on the landing target can be prevented.

In the above first embodiment, the adjustment section may change the driving signal such that when the scanning mechanism moves the landing target and the liquid ejecting head in a first relative movement direction, in which after the second liquid first lands on the landing target, the first liquid lands, the ejection weight of the second liquid is small relative to the ejection weight of the second liquid resulting from use of the unchanged driving signal when the scanning mechanism moves the landing target and the liquid ejecting head in a second relative movement direction, in which after the first liquid first lands on the landing target, the second liquid lands. Alternatively, the adjustment section may change the driving signal such that when the scanning mechanism moves the landing target and the liquid ejecting head in the first relative movement direction, the ejection weight of the second liquid is large relative to the ejection weight of the second liquid resulting from use of the unchanged driving signal when the scanning mechanism moves the landing target and the liquid ejecting head in the second relative movement direction.

According to this configuration, since the ejection weight of the second liquid is made smaller in the first relative movement direction, or larger in the second relative movement direction, it is possible to suppress a difference in density between the landed liquids due to a difference in the landing sequence in either the first relative movement direction or the second relative movement direction.

In the above first embodiment, the adjustment section may adjust the ejection weight by changing a driving voltage of one or more driving pulses in the driving signal that is applied to the pressure generation sections.

In addition, the "driving voltage" means a difference in electric potential between the lowest electric potential and the highest electric potential of the driving pulse.

According to this configuration, since the adjustment section adjusts the ejection weight by changing the driving voltage of the one or more driving pulses in the driving signal that is applied to the pressure generation section, the ejection weight of liquid can be easily adjusted.

In the above first embodiment, the adjustment section may adjust the ejection weight by changing a number of the one or more driving pulses in the driving signal that is applied to the pressure generation section.

According to this configuration, since the adjustment section adjusts the ejection weight by changing the number of the one or more driving pulses included in the driving signal that is applied to the pressure generation section, it is possible to expand an adjustment amount of the ejection weight of liquid, compared to the case of changing the driving voltage of the driving pulse.

According to a second embodiment of the invention, there is provided a method of controlling a liquid ejecting apparatus that includes a liquid ejecting head. The method includes adjusting an ejection weight of at least one of the first liquid and the second liquid by changing the driving signal in accordance with the landing sequence of the first liquid and the second liquid on the landing target. The first liquid includes a dye-based color material and is ejected by a first nozzle group having nozzles arranged in line in a direction intersecting a movement direction of the liquid ejecting head relative to the landing target. Moreover, the second liquid includes a pigment-based color material and is ejected by a second nozzle group having nozzles arranged in line in parallel to the first nozzle group. The driving signal includes one or more driving pulses for driving pressure generation sections corresponding to the nozzles in the first and second nozzle groups, the pressure generation sections being configured to cause ejection of ink from the nozzles in response to being driven by the driving signal by varying the volume of pressure chambers corresponding to and in communication with the nozzles. In addition, the liquid ejecting head and the landing target are moved relative to each other by a scanning mechanism According to the configuration of the above second embodiment, since the ejection weight of at least one of the first liquid and the second liquid is adjusted by changing the driving signal in accordance with the landing sequence of the first liquid and the second liquid on the landing target, even if the landing sequence of liquids which include different color materials differs in the forward path and the return path in the relative movement direction, density unevenness caused by a difference in infiltration rate between liquids into the landing target can be reduced with a simple configuration, so that deterioration of the image quality of an image or the like formed on the landing target can be prevented.

In the above second embodiment, adjusting the ejection weight may include changing the driving signal such that when the scanning mechanism moves the landing target and the liquid ejecting head in a first relative movement direction, in which after the first liquid first lands on the landing target, the second liquid lands, the ejection weight of the second liquid is large relative to the ejection weight of the second liquid resulting from use of the unchanged driving signal in a second relative movement direction, in which after the second liquid first lands on the landing target, the first liquid lands. Alternatively, adjusting the ejection weight may include changing the driving signal such that in the second relative movement direction, the ejection weight of the second liquid is small relative to the ejection weight of the first liquid resulting from use of the unchanged driving signal in the first relative movement direction.

According to this configuration, since the ejection weight of the second liquid is made larger in the first relative movement direction, or smaller in the second relative movement direction, it is possible to suppress a difference in density between landed liquids due to a difference in landing sequence in either the first relative movement direction or the second relative movement direction.

In the above configuration, the ejection weight may be adjusted by changing a driving voltage of the one or more driving pulses in the driving signal that is applied to the pressure generation section.

According to this configuration, since the ejection weight is adjusted by changing the driving voltage of the one or more driving pulses in the driving signal that is applied to the pressure generation section, the ejection weight of liquid can be easily adjusted.

In the above second embodiment, the ejection weight may be adjusted by changing a number of the one or more driving pulses in the driving signal that is applied to the pressure generation section.

According to this configuration, since the ejection weight is adjusted by changing the number of the one or more driving pulses included in the driving signal that is applied to the pressure generation section, it is possible to expand an adjustment amount of the ejection weight of liquid, compared to the case of changing the driving voltage of the driving pulse.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Additional features will be set forth in the description which follows, and in part will be obvious from the description, or may be learned by the practice of the teachings herein. Features of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

Aspects of example embodiments of the invention will become apparent from the description of the accompanying drawings, wherein like numbers reference like elements.

FIGS. 7A and 7B are schematic diagrams illustrating the landed state of ink on recording paper, wherein FIG. 7A shows a state in a forward path and FIG. 7B shows a state in a return path;

FIGS. 10A and 10B are schematic diagrams illustrating the landed state of ink on the recording paper according to another embodiment of the invention, wherein FIG. 10A shows a state in a forward path and FIG. 10B shows a state in a return path.

DESCRIPTION OF EXEMPLARY EMBODIMENTS

Hereinafter, various embodiments of the invention will be described with reference to the accompanying drawings or the like. In addition, although in embodiments which are described below, various limitations are given as preferred specific examples of the invention, the scope of the invention is not to be limited to these aspects unless expressly stated hereinafter. Also, an ink jet type recording apparatus (hereinafter referred to as a printer) is described only as an example of a liquid ejecting apparatus according to embodiments described herein.

Figure 1:
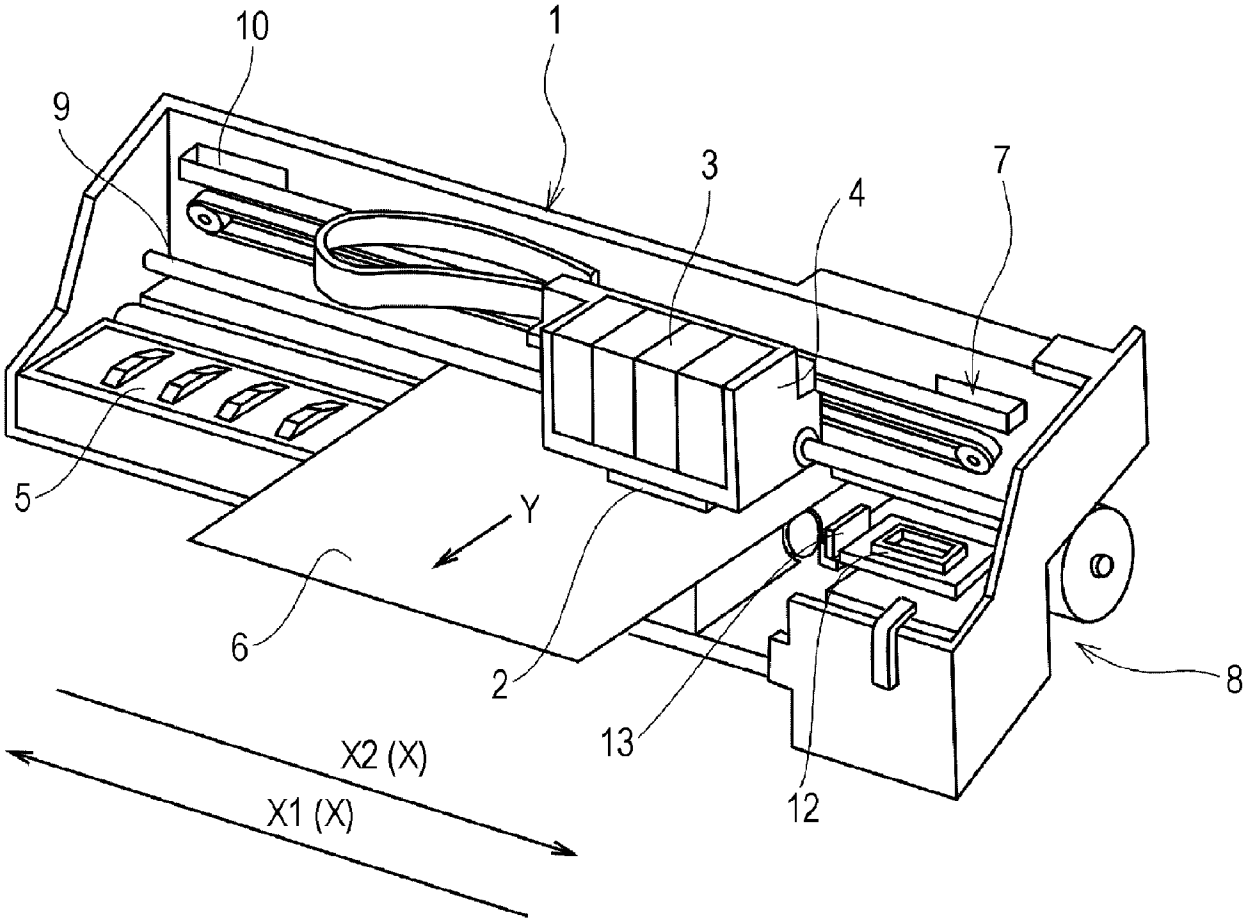
FIG. 1 is a perspective view illustrating a schematic configuration of a printer.
Figure 2:
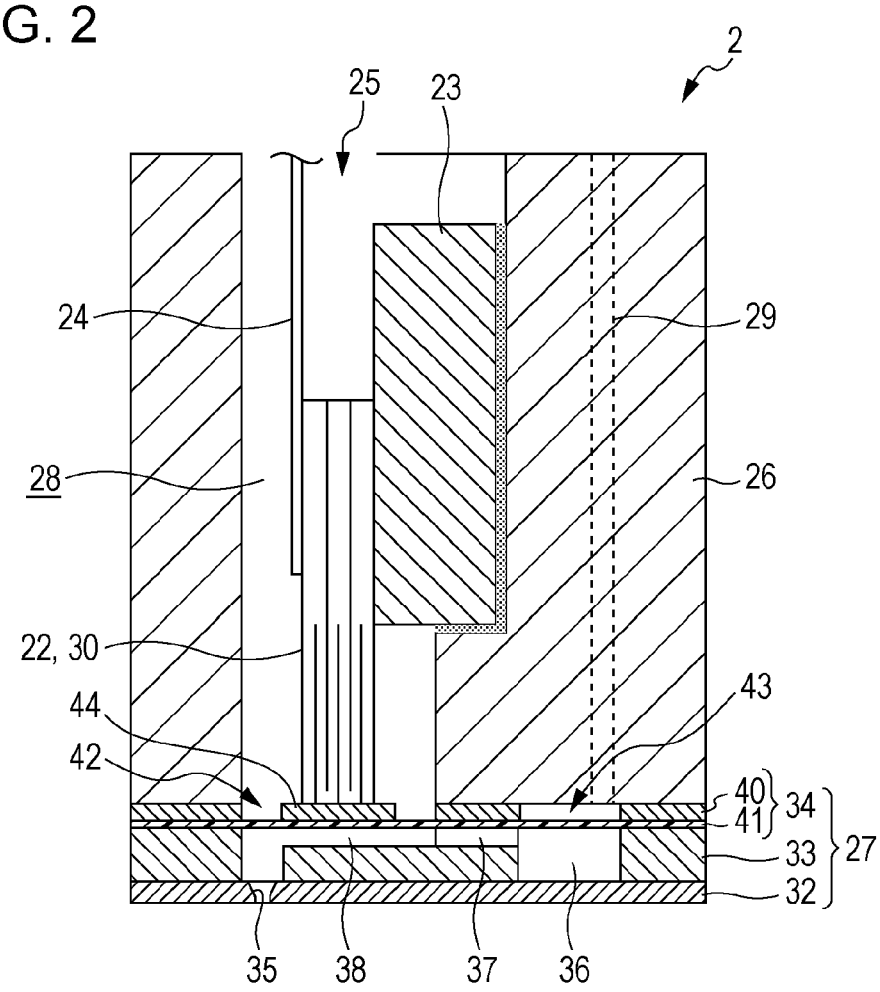
FIG. 2 is a cross-sectional view of a main section illustrating the configuration of a recording head in the printer of FIG. 1.

FIG. 1 is a perspective view illustrating the configuration of a printer 1, and FIG. 2 is a cross-sectional view of a main section of a recording head 2 included in the printer 1 of FIG. 1. The printer 1 is generally constituted to include a carriage 4, on which a liquid ejecting head, such as the recording head 2, is mounted, and also on which an ink cartridge 3 that contains a liquid, such as ink, is detachably mounted. The printer also includes a platen 5 disposed below the recording head 2, a carriage movement mechanism 7 (i.e., a scanning mechanism) that reciprocates the carriage 4 with the recording head 2 mounted thereon in the paper width direction of recording paper 6 (i.e., a landing target), a paper feed mechanism 8 that transports the recording paper 6 in a paper feeding direction that is perpendicular to the paper width direction, and the like. The paper width direction is a main scanning direction (a relative movement direction indicated by a symbol X in FIG. 1) and the paper feeding direction is a sub-scanning direction (a direction perpendicular to the relative movement direction, indicated by a symbol Y in FIG. 1).

The carriage 4 is mounted in a state where it is supported on a guide rod 9 provided to extend in the main scanning direction X, and constituted so as to move in the main scanning direction X along the guide rod 9 by an operation of the carriage movement mechanism 7. A position in the main scanning direction X of the carriage 4 is detected by a linear encoder 10 and a detection signal is transmitted to a control section 56 (refer to FIG. 4) as position information. Accordingly, the control section 56 can control a recording operation (i.e., ejection operation) or the like by the recording head 2 while recognizing a scanning position of the carriage 4 (and thus the recording head 2 mounted thereon) on the basis of the position information from the linear encoder 10.

A home position that is a base point of scanning is disposed at an end portion area disposed outside of (toward the right side in FIG. 1) a recording area within a movement range of the carriage 4. At the home position in this embodiment, a capping member 12 that seals a nozzle formation face (a nozzle plate 32; refer to FIGS. 2 and 3) of the recording head 2, and a wiper member 13 for sweeping the nozzle formation face are disposed. The printer 1 is configured such that so-called bi-directional recording is possible in which a character, an image, or the like is recorded on the recording paper 6 in both directions, i.e., in a forward path direction (indicated by a symbol X1 in FIG. 1, i.e., a first relative movement direction) traversed during forward movement in which the carriage 4 (and thus the recording head 2) moves from the home position toward an end portion on the opposite side and a return path direction (indicated by a symbol X2 in FIG. 1, i.e., a second relative movement direction) traversed during return movement in which the carriage 4 returns from the end portion on the opposite side to the home position side.

As shown in FIG. 2, the recording head 2 in this embodiment is constituted to include a vibrator unit 25 having a piezoelectric vibrator group 22, a fixed plate 23, a flexible cable 24, and the like, a head case 26 capable of housing the vibrator unit 25, and a flow path unit 27, which forms a successive ink flow path that extends from a reservoir (common ink chamber) 36 through a pressure chamber 38 to a nozzle 35.

First, the vibrator unit 25 will be described. A piezoelectric vibrator 30 (or other type of pressure generation section) constituting the piezoelectric vibrator group 22 is formed into a comb-tooth shape elongated in a longitudinal direction, and is cut into a very thin width of about several tens of μm. The piezoelectric vibrator 30 is configured as a longitudinal vibration type piezoelectric vibrator capable of extending or contracting in a longitudinal direction. Each piezoelectric vibrator 30 is fixed in the state of a so-called cantilever beam with a fixed end portion joined to the fixed plate 23 and a free-end portion protruding further outside than the leading end edge of the fixed plate 23. Then, the leading end of the free-end portion of each piezoelectric vibrator 30 is joined to an island portion 44 which constitutes a diaphragm portion 42 in each flow path unit 27, as will be described later. The flexible cable 24 is electrically connected to the piezoelectric vibrator 30 at the side of the fixed end portion, which is the opposite side to the fixed plate 23. Also, the fixed plate 23 supporting each piezoelectric vibrator 30 is constituted by a metallic plate material having rigidity capable of bearing a reaction force from the piezoelectric vibrator 30. In one embodiment, the metallic plate may be made of stainless steel and may have a thickness of about 1 mm.

The head case 26 is a hollow box-shaped member made of, for example, epoxy-based resin, and to the leading end face (the lower surface) thereof, the flow path unit 27 is fixed, and in a housing hollow portion 28 formed in the inside of the case, the vibrator unit 25 or other type of actuator is housed. Also, in the inside of the head case 26, a case flow path 29 is formed to penetrate in the height direction thereof. The case flow path 29 is a flow path for supplying ink from the ink cartridge 3 side to the reservoir 36.

Next, the flow path unit 27 will be described. The flow path unit 27 is composed of the nozzle plate 32, a flow path formation substrate 33, and a vibration plate 34 and is constituted by disposing the nozzle plate 32 on the surface of one side of the flow path formation substrate 33 and the vibration plate 34 on the surface of the other side of the flow path formation substrate 33, which is the opposite side to the nozzle plate 32, so as to form a lamination, and then integrating them by adhesion or the like.

Figure 3:
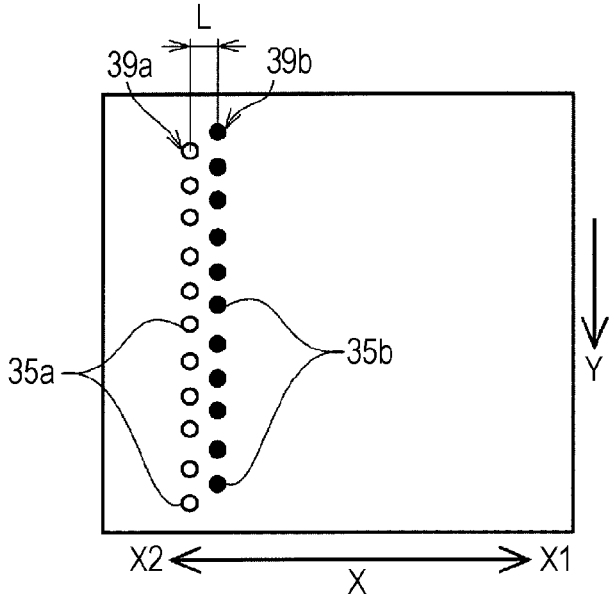
FIG. 3 is a plan view of a nozzle plate of the recording head of FIG. 2.

FIG. 3 is a plan view of the nozzle plate 32 of the recording head 2.

The nozzle plate 32 which is disposed at the bottom of the flow path unit 27 is a thin metal plate in which a plurality of nozzles 35 are opened and provided along the sub-scanning direction Y at a pitch (for example, 180 dpi) corresponding to dot formation density. In this embodiment, for example, 180 nozzles 35 are opened and provided in line to form a column of nozzles 39 (i.e., a nozzle group). The recording head 2 has nozzles 35*a* (any one of which is also referred to herein as a first nozzle), each of which ejects a first liquid, such as dye ink including a dye-based color material that is mainly used for text printing. The recording head 2 also has nozzles 35*b* (any one of which is also referred to herein as a second nozzle), each of which ejects a second liquid, such as pigment ink including a pigment-based color material that is mainly used for photograph printing. The nozzles 35*a* are arranged in line as a column of nozzles 39*a* (i.e., a first nozzle group), and the nozzles 35*b* are arranged in line as a column of nozzles 39*b* (i.e., a second nozzle group) in parallel to the column of nozzles 39*a*. A relative position of nozzles in the two parallel columns 39*a* and 39*b* is shifted by one half of a pitch (pitch between the nozzles) in the sub-scanning direction Y and the columns are spaced from each other at an interval (the distance between the columns of nozzles; indicated by L in the drawing) in the main scanning direction X. That is, in the nozzle plate 32, the column of nozzles 39*a* composed of the nozzles 35*a* ejecting dye ink and the column of nozzles 39*b* composed of the nozzles 35*b* ejecting pigment ink are disposed side by side in the main scanning direction X. In addition, compared to the pigment ink, the dye ink more easily infiltrates into the recording paper 6 when it has landed on the recording paper 6.

The flow path formation substrate 33 is a plate-like member, in which a successive ink flow path composed of the reservoir 36, an ink supply port 37, and the pressure chamber 38 is formed. Specifically, the flow path formation substrate 33 is a plate-like member, in which a plurality of space portions that each becomes the pressure chamber 38 is formed in a state where the space portions are partitioned by partition walls to correspond to the respective nozzles 35, and also in which space portions that become the ink supply port 37 and the reservoir 36 are formed. The flow path formation substrate 33 may be manufactured by etching a silicon wafer. The pressure chamber 38 is formed as a chamber that is thin and elongated in a direction orthogonal to the column direction of the nozzles 35 (a nozzle column direction), and the ink supply port 37 is formed as a narrowed portion with a narrow flow path width that communicates between the pressure chamber 38 and the reservoir 36. Also, the reservoir 36 is a chamber for supplying ink stored in the ink cartridge 3 to each pressure chamber 38 and communicates with a corresponding pressure chamber 38 through the ink supply port 37.

The vibration plate 34 is a composite plate material of a double structure in which a resin film 41 such as PPS (polyphenylene sulfide) is laminated on a support plate 40 made of metal such as stainless steel. The resin film 41 includes the diaphragm portion 42 for sealing an opening face of one side of the pressure chamber 38 and changing the volume of the pressure chamber 38 and includes a compliance portion 43 that seals an opening face of one side of the reservoir 36. The diaphragm portion 42 may be formed by performing etching on the support plate 40 of a portion corresponding to the pressure chamber 38 to annularly remove the portion, thereby forming the island portion 44 for joining the leading end of the free-end portion of the piezoelectric vibrator 30. The island portion 44 has a block shape that is thin and elongated in a direction orthogonal to the column direction of the nozzles 35, similar to the planar shape of the pressure chamber 38. The resin film 41 around the island portion 44 functions as an elastic body film. Also, the portion serving as the compliance portion 43, that is, the portion corresponding to the reservoir 36, is composed of only the resin film 41 as the support plate 40 is removed in accordance with the opening shape of the reservoir 36 by etching.

Since the leading end face of the piezoelectric vibrator 30 is joined to the island portion 44, the volume of the pressure chamber 38 can be varied by extending and contracting the free-end portion of the piezoelectric vibrator 30. Pressure fluctuations occur in ink in the pressure chamber 38 in accordance with the volume variation. Then, the recording head 2 is made so as to eject an ink droplet from the nozzle 35 by using the pressure fluctuations. In addition, the recording head 2 in the invention is configured so as to eject an ink droplet from the nozzle 35*a* by driving a first piezoelectric vibrator (i.e., a first pressure generation section) that varies the volume of the pressure chamber 38 that communicates with the nozzle 35*a*, and on the other hand, is also configured so as to eject an ink droplet from the nozzle 35*b* by driving a second piezoelectric vibrator (i.e., a second pressure generation section) that varies the volume of the pressure chamber 38 that communicates with the nozzle 35*b*.

Next, the electrical configuration of the printer 1 will be described.

Figure 4:
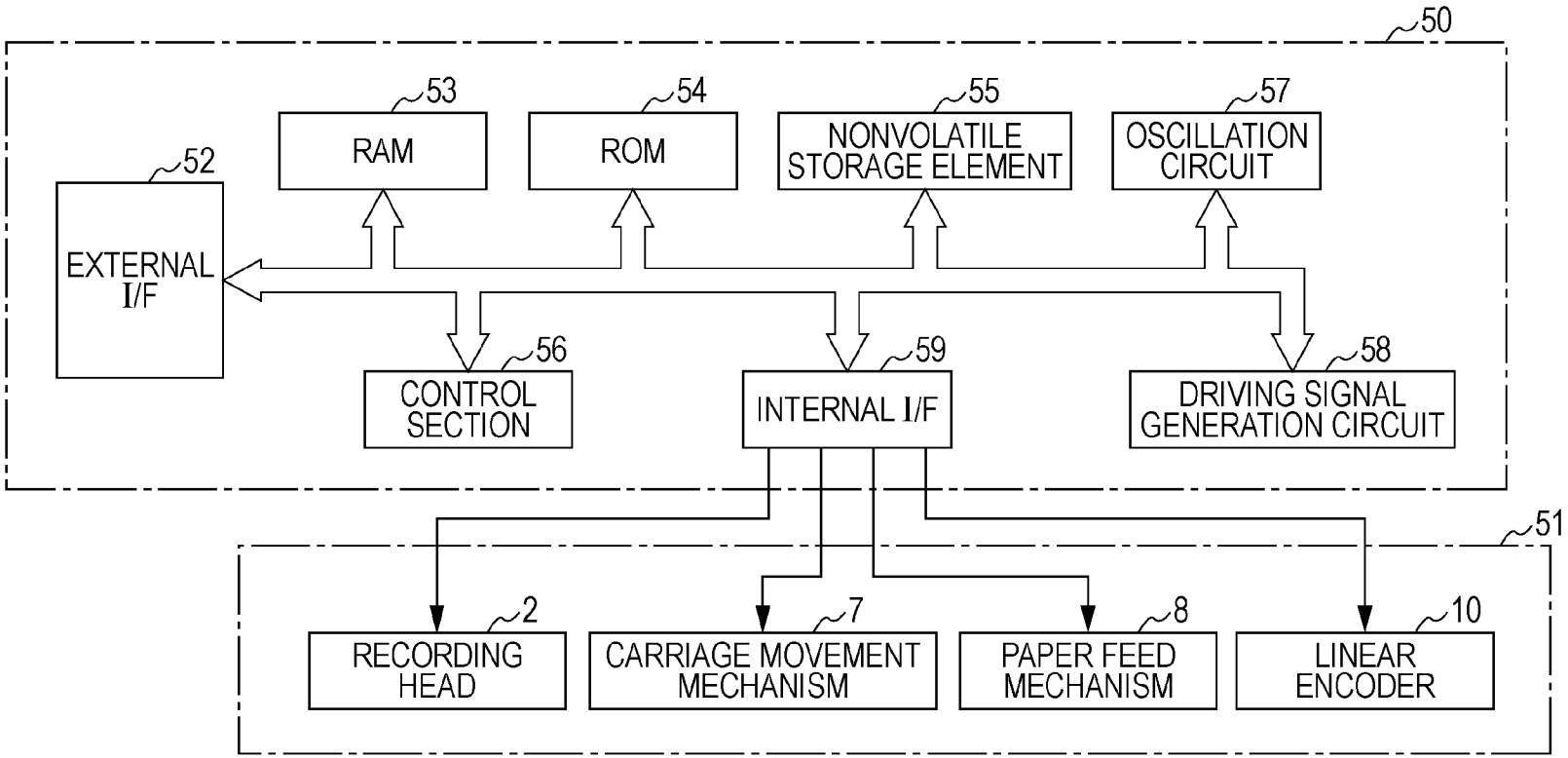
FIG. 4 is a block diagram illustrating the electrical configuration of the printer of FIG. 1.

FIG. 4 is a block diagram showing the electrical configuration of the printer 1. The printer 1 in this embodiment generally comprises a printer controller 50 and a print engine 51. The printer controller 50 includes an external interface (an external I/F) 52, to which data from an external apparatus such as a host computer is input, a RAM 53 that stores various data or the like, a ROM 54 that stores control routines or the like for various data processes, a nonvolatile storage element 55 composed of an EEPROM, a flash ROM, or the like, the control section 56 (i.e., an adjustment section) that carries out control of each section, an oscillation circuit 57 that generates a clock signal, a driving signal generation circuit 58 (i.e., a driving signal generation section) that generates a driving signal COM that is supplied to the recording head 2, and an internal interface (an internal I/F) 59 for outputting printing data (dot pattern data), the driving signal COM, or the like to the recording head 2. The print engine 51 includes the recording head 2, the carriage movement mechanism 7, the paper feed mechanism 8, and the linear encoder 10.

The control section 56 converts the printing data received from the external apparatus through the external I/F 52 into the dot pattern data and outputs the dot pattern data to the recording head 2 side through the internal I/F 59. The dot pattern data includes printing data that is obtained by decoding (interpreting) gradation data. Also, the control section 56 supplies a latch signal LAT and a change signal CH to the recording head 2 on the basis of the clock signal from the oscillation circuit 57. The latch signal or the change signal defines the supply timing of each driving pulse DP constituting the driving signal COM.

Figure 5:
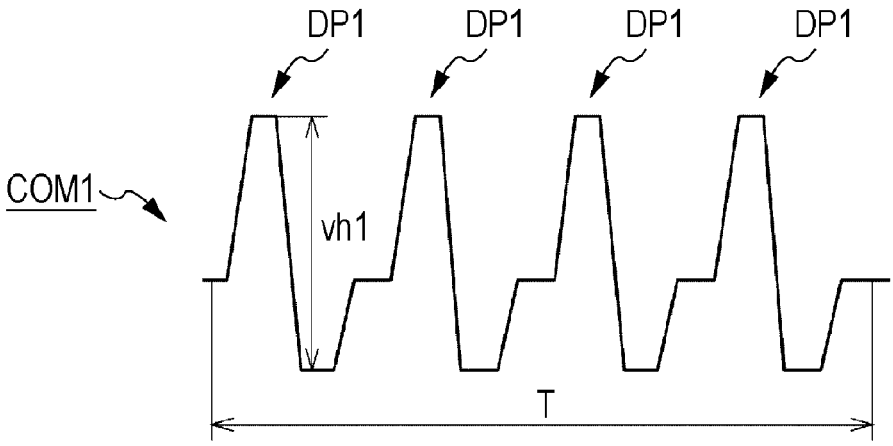
FIG. 5 is a waveform diagram illustrating the configuration of a basic driving signal used to drive the recording head of FIG. 2.

FIG. 5 is a waveform diagram describing the configuration of a basic driving signal COM1. The driving signal generation circuit 58 generates a successive basic driving signal COM1, which includes a plurality of driving pulses DP1 for ejecting ink from the nozzle 35 toward the recording paper 6 by driving the piezoelectric vibrator 30, in one ejection period T corresponding to a period in which one pixel (a formation unit of an image or the like) is formed on the recording paper 6. The basic driving signal COM1 in the embodiment includes four driving pulses DP1 in one ejection period (i.e., one recording period; indicated by a symbol T in FIG. 5) and these four driving pulses constitute a repetition unit. The driving signal generation circuit 58 supplies the basic driving signal COM1 to the recording head 2 side through the internal I/F 59.

Figure 6:
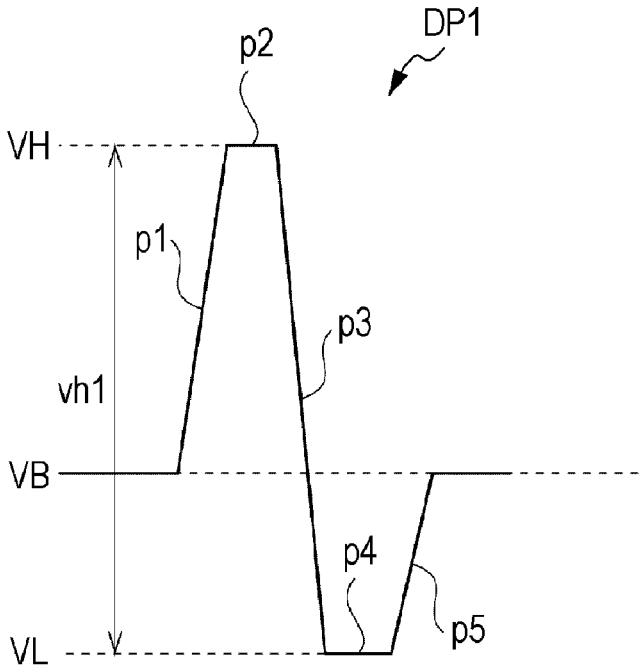
FIG. 6 is a waveform diagram illustrating the configuration of a driving pulse included in the basic driving signal.

FIG. 6 is a waveform diagram describing the configuration of the driving pulse DP1 that is included in the basic driving signal COM1 generated by the driving signal generation circuit 58 having the above configuration. In addition, in FIG. 6, the vertical axis indicates the electric potential of the driving pulse DP1 and the horizontal axis indicates a time [μs]. Also, a difference in electric potential (driving voltage) between the lowest electric potential VL and the highest electric potential VH of the driving pulse DP1 is set to be vh1.

The driving pulse DP1 includes an expansion element p1, in which an electric potential changes to the plus side from a reference electric potential VB up to an expansion electric potential VH, thereby expanding the pressure chamber 38. The driving pulse DP1 also includes an expansion maintaining element p2 that maintains the expansion electric potential VH for a given length of time. Next comes a contraction element p3, in which an electric potential changes to the minus side from the expansion electric potential VH to a contraction electric potential VL, thereby rapidly contracting the pressure chamber 38. After the contraction element p3 is a contraction maintaining (vibration suppression holding) element p4, which maintains the contraction electric potential VL for a given length of time. Finally, the driving pulse DP1 includes a return element p5, in which an electric potential returns from the contraction electric potential VL up to the reference electric potential VB.

If the driving pulse DP1 is supplied to the piezoelectric vibrator 30, the recording head 2 performs various actions. First, when the expansion element p1 of the driving pulse DP1 is supplied to the piezoelectric vibrator 30, the piezoelectric vibrator 30 contracts and, consequently, the pressure chamber 38 changes in volume. More specifically, the pressure chamber 38 expands from a reference volume corresponding to the reference electric potential VB up to the largest volume corresponding to the highest electric potential VH. As a result, a meniscus that is exposed to the nozzle 35 is drawn to the pressure chamber 38 side. The expanded state of the pressure chamber 38 is maintained to be constant over a supply period of the expansion maintaining element p2.

The contraction element p3 of the driving pulse DP1 changes a voltage of the driving pulse DP1 in a direction opposite to the direction in which the voltage has been changed by the expansion element p1. Therefore, when the contraction element p3 is supplied to the piezoelectric vibrator 30 following the expansion maintaining element p2, the piezoelectric vibrator 30 extends and, accordingly, the pressure chamber 38 rapidly changes in volume. More specifically the pressure chamber 38 contracts from the above-mentioned largest volume down to the smallest volume corresponding to the lowest electric potential VL. Due to the rapid contraction of the pressure chamber 38, ink in the pressure chamber 38 is pressurized, whereby ink in the range of several p1 to several tens of p1 is ejected from the nozzle 35. The contracted state of the pressure chamber 38 is maintained for a short time over a supply period of the contraction maintaining element p4, and thereafter, the vibration control element p5 is supplied to the piezoelectric vibrator 30, causing the pressure chamber 38 to return from a volume corresponding to the lowest electric potential VL up to the reference volume corresponding to the reference electric potential VB.

Figure 7A:
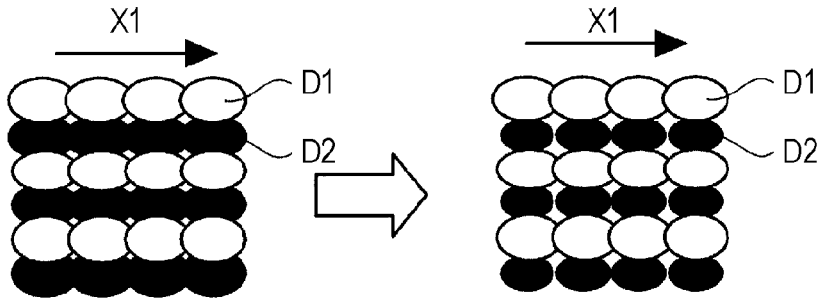
Figure 7B:
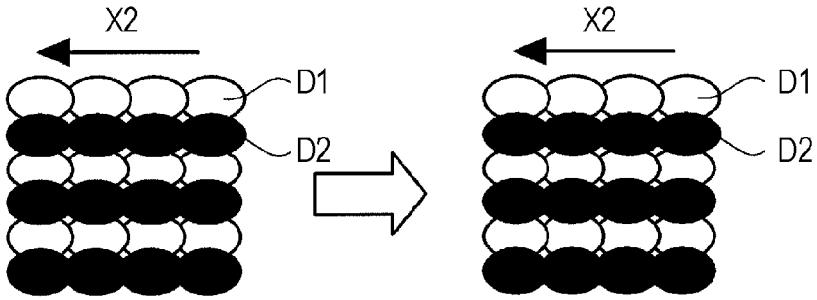

FIGS. 7A and 7B are schematic diagrams describing the landed state of ink on the recording paper 6, wherein FIG. 7A shows a state in a forward path and FIG. 7B shows a state in a return path.

Next, an explanation will be made with respect to a landed state in which the dye ink and the pigment ink, respectively ejected from the nozzles 35*a* and the nozzles 35*b*, have landed on the recording paper 6. The ink is ejected by supplying the basis driving signal COM1 to the piezoelectric vibrator 30 while reciprocating the recording head 2 along the main scanning direction X. In addition, in the following description, it is assumed that a so-called "solid painting printing" which fills out a given area on the recording paper 6 by using the pigment ink and the dye ink is carried out. When carrying out solid painting printing, a large dot composed of a plurality of smaller unit dots is formed at a pixel area on the recording paper 6 by consecutively ejecting ink several times from a corresponding nozzle 35 by applying plural (for example, four) driving pulses DP1 of the basis driving signal COM1 in one ejection period T to the piezoelectric vibrator 30. One dot in FIGS. 7A and 7B represents a dot (i.e., a large dot) for one pixel.

Initially, for contrast, a case will be described in which the basic driving signal COM1 is used when both the forward path and the return path are traversed (i.e., a case where the invention is not applied). The initial case will be described with reference to the left half of each of FIGS. 7A and 7B. Subsequently, the right half of each of FIGS. 7A and 7B will be referenced in describing a case in which a driving signal COM2 is used in the forward path and the basic driving signal COM1 is used in the return path.

First, when the recording head 2 performs scanning in the forward path direction X1, as shown in the left half of FIG. 7A, the pigment ink ejected from each nozzle 35*b* in the column of nozzles 39*b* lands in a column shape (the first column on the leftmost side of the drawing). The dots formed by the pigment ink are separated from each other by one half of a pitch in the sub-scanning direction Y (a vertical direction in the figure) in correspondence with the pitch of the nozzle 35*b* in the column of nozzles 39*b*. When the pigment ink lands on the recording paper 6, a pigment constituent is deposited on the surface of the recording paper 6 and does not almost infiltrate into the inside of the recording paper. As a result, the first column of dots D2 is formed, which includes dots of pigment ink (indicated by D2 in the drawing) arranged in a spaced apart pattern along the sub-scanning direction Y.

Next, after the recording head 2 performs scanning at a given pitch (for example, for about one dot) in the forward path direction X1, the pigment ink ejected from each nozzle 35*b* in the column of nozzles 39*b* lands again in a column shape (the second column from the left side of the drawing). As with the first column of dots described above, the dots are separated from each other by one half of a pitch in the sub-scanning direction Y, but separated from the first column of dots D2 of pigment ink by a given pitch in the forward path direction X1. Consequently, the pigment constituent of the pigment ink of the second column landed on the recording paper 6 is deposited next to each dot D2 of pigment ink of the adjacent first column. As a result, the second column of dots D2 is formed, which includes the dots D2 of pigment ink arranged in a spaced apart pattern along the sub-scanning direction Y. In this manner, by sequentially forming the dots D2 by ejecting ink from the nozzles 35*b* while scanning the recording head 2, the dots D2 adjacent to each other in the main scanning direction X are connected to each other, so that the row of dots D2 is formed along the main scanning direction X.

On the other hand, when the recording head 2 has performed scanning by a distance corresponding to the interval L (i.e., the distance separating the columns 39*a* and 39*b*) with respect to the first column of dots D2, the dye ink is ejected from each nozzle 35*a* in the column of nozzles 39*a*. The dye ink that is ejected from the nozzles 35*a* lands in a column shape (the first column on the leftmost side in the drawing). The dots are separated from each other by one half of a pitch in the sub-scanning direction Y, so as to fill up the distance between the dots D2 of pigment ink of the first column previously landed on the recording paper 6. Consequently, the dye ink landed on the recording paper 6 covers the recording paper 6 in a state where the dye ink is connected to end portions (upper and lower ends) of each dot D2 of pigment ink of the adjacent first column by spreading on the surface of the recording paper 6 around the landed position thereof while some of the dye ink infiltrates into the recording paper 6. As a result, the first column of dots D1, which is composed of dots of dye ink (indicated by D1 in the drawing), is arranged in a spaced apart pattern along the sub-scanning direction Y, whereby dots of dye ink D1 and dots of pigment ink D2 are alternately formed such that the dots D1 and D2 adjacent to each other in the sub-scanning direction Y are connected to each other. In this manner, by sequentially forming the dots D1 by ejecting ink from the nozzle 35*a* while the recording head 2 performs scanning, the dots D1 adjacent to each other in the main scanning direction X are connected to each other, so that the row of the dots D1 is formed between the rows of the dots D2.

Also, when the recording head 2 performs scanning in the return path direction X2 opposite to the forward path direction X1, as shown in the left half of FIG. 7B, the landing sequence of the dye ink and the pigment ink in the recording paper 6 is reversed with respect to the landing sequence described above in which scanning is performed in the forward path direction X1. That is, when the recording head 2 performs scanning in the return path direction X2, the dye ink dots D1 of any given column of dots are ejected onto the recording paper 6 before the pigment ink dots D2 are ejected. After the dye ink first lands, whereby the column of the dots D1 is formed, if the pigment ink lands between the dots D1 of this column, whereby the dot D2 is formed, a portion of the pigment constituent of the pigment ink is pulled to the dot D1 side of dye ink accompanying the infiltration of the previously landed dye ink onto the recording paper, so that the density of the dot D2 becomes thinner by a corresponding amount. Accordingly, in a case where the recording head 2 performs scanning in the return path direction X2, the visual density of the dots D1 and D2 formed on the recording paper 6 becomes thinner compared to the case of scanning in the forward path direction X1.

In this manner, the dye ink infiltrates into the recording paper 6 more easily than the pigment ink, and when the landing sequence of the dye ink and the pigment ink in the recording paper 6 differs in the forward path and the return path in the main scanning direction X, density unevenness (also called color unevenness) due to the change in landing sequence of inks occurs. In particular, in a case where the dye ink and the pigment ink land in an overlapping manner on the recording paper 6, there is a fear that due to a difference in landing sequence with respect to the recording paper 6, density unevenness occurs in an image or the like recorded on the recording paper 6, so that image quality deteriorates. Specifically, in a case where after the pigment ink first lands in the recording paper 6, the dye ink lands, compared to a case where after the dye ink first lands in the recording paper 6, the pigment ink lands, the visual density of the dots D1 and D2 formed by the landed ink sometimes becomes thicker.

Therefore, in the printer 1 according to one embodiment of the invention, the control section 56 changes the driving signal COM in accordance with the landing sequence of the dye ink and the pigment ink, thereby adjusting the ejection amount of at least one of the dye ink and the pigment ink. More specifically, the control section 56 of this embodiment sets the driving signal for a forward path COM2 that is used for ejection of the column of nozzles 39*b* corresponding to the pigment ink, such that in the forward path direction X1 in which the dye ink lands after the pigment ink first lands on the recording paper 6, the ejection weight of the pigment ink is small relative to the ejection weight of the second liquid resulting from use of the basic driving signal COM1, which is used in the return path direction X2 in which the pigment ink lands after the dye ink first lands on the recording paper 6. The driving signal for a forward path COM2 in the invention will be described below.

Figure 8:
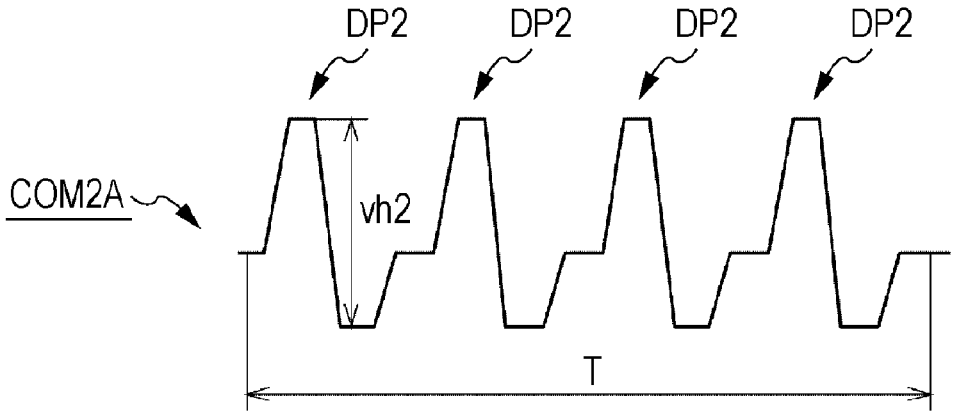
FIG. 8 is a waveform diagram illustrating the configuration of a driving signal for the forward path.

FIG. 8 is a waveform diagram describing the configuration of a driving signal for a forward path COM2A.

The driving signal generation circuit 58 in one embodiment generates a successive driving signal for a forward path COM2A, which includes a plurality of driving pulses DP2 in one ejection period T. The driving signal for a forward path COM2A in this embodiment includes four driving pulses DP2 in a section for one pixel and sets them to be a repetition unit. Driving voltage vh2 of the driving pulse DP2 is set to be a value smaller than the driving voltage vh1 of the driving pulse DP1 (vh2<vh1). The control section 56 uses the basic driving signal COM1 when ejecting both the dye ink and the pigment ink in the return path direction X2. On the other hand, in the forward path direction X1, the control section 56 uses the basic driving signal COM1 when ejecting the dye ink, and uses the driving signal for a forward path COM2A when ejecting the pigment ink. By supplying the driving signal for a forward path COM2A to the piezoelectric vibrator 30 corresponding to the nozzle 35*b*, which ejects the pigment ink, in the forward path direction X1, the ejection amount of the pigment ink is small relative to the dot D2 landed on the recording paper 6 when the basic driving signal COM1 is used in the return path direction X2, as shown by the size of the dots D2 in the right half of FIG. 7A as compared to the dots D2 in the right half of FIG. 7B. Accordingly, a difference in density between the forward path direction X1 and the return path direction X2 is reduced by aligning the density of the dots D1 and D2 in the forward path direction X1 with the density of the dots D1 and D2 in the return path direction X2.

Figure 9:
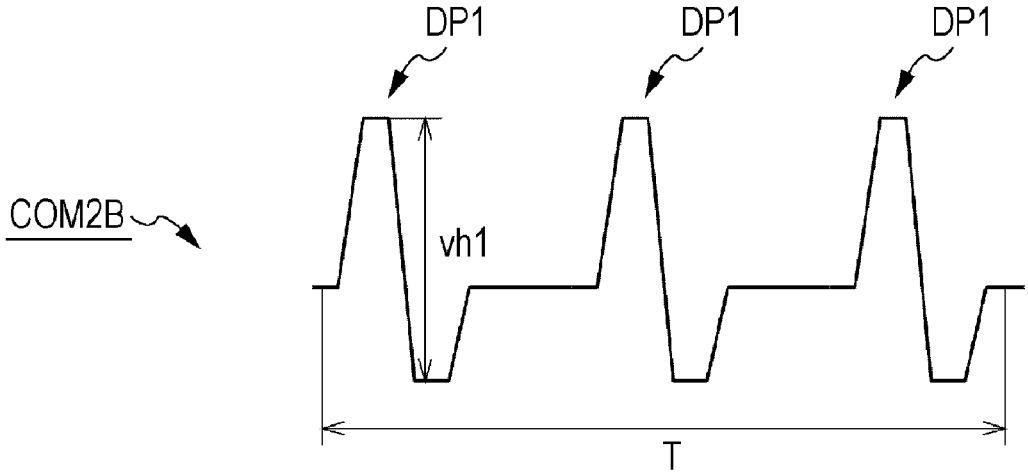
FIG. 9 is a waveform diagram illustrating the configuration of a modified example of the driving signal for the forward path.

FIG. 9 is a waveform diagram describing the configuration of a modified example of the driving signal for a forward path.

The driving signal for a forward path COM2 is not limited to the driving signal for a forward path COM2A described above. For example, it may be changed to a driving signal for a forward path COM2B which includes three driving pulses DP1 in a section for one pixel and sets them to be a repetition unit. Accordingly, since the control section 56 adjusts ink ejection weight by changing the number of the driving pulses DP that are included in the driving signal COM applied to the piezoelectric vibrator 30, that is, since an amount of ink that lands per pixel is adjusted, it is possible to expand an adjustment amount of the ink ejection weight, compared to the case of changing the driving voltage vh of the driving pulse DP, so that density unevenness caused by a difference in infiltration rate between inks when they have landed on the recording paper 6 can be reduced with a simple configuration. In addition, more precise ink ejection weight adjustment is possible by reducing the pulse number of the driving pulses DP included in the driving signal COM and by simultaneously increasing the driving voltage vh of the driving pulse DP.

Figure 10A:
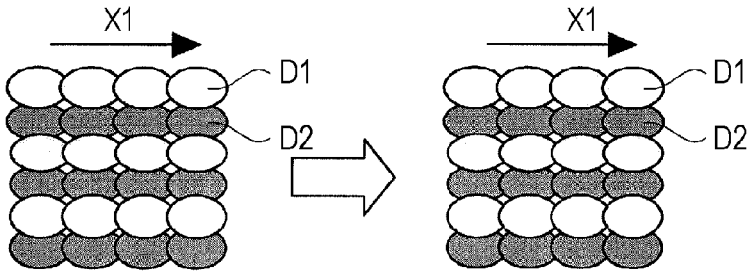
Figure 10B:
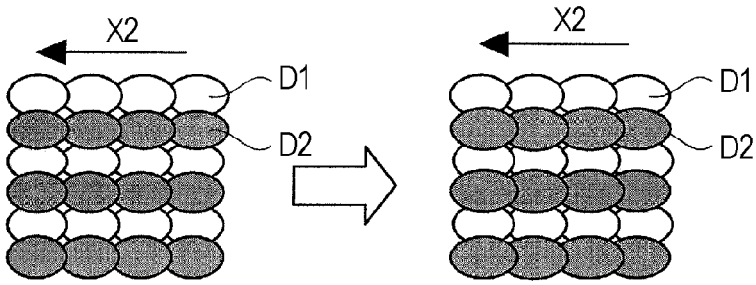

FIGS. 10A and 10B are schematic diagrams describing the landed state of ink landed on the recording paper 6 in another embodiment, wherein FIG. 10A shows a state in the forward path and FIG. 10B shows a state in the return path.

In the above-described embodiment of FIGS. 7A and 7B, a configuration has been described in which the driving signal for a forward path COM2 is set such that in the forward path direction X1, the ejection weight of the pigment ink is small relative to the ejection weight of pigment ink produced by application of the basic driving signal COM1, which is used in the return path direction X2. However, this embodiment is provided by way of example, not limitation. For example, according to an alternative embodiment, a driving signal for a return path COM3 (not shown) may be set such that in the return path direction X2, the ejection weight of the pigment ink becomes relatively large compared to the ejection weight of pigment ink produced by application of the basic driving signal COM1 that is used in the forward path direction X1. Specifically, the control section 56 may make driving voltage vh3 of a driving pulse DP3 (not shown), which is included in a driving signal for a return path COM3A which is applied to the piezoelectric vibrator 30, higher than the driving voltage vh1 of the driving pulse DP1. Alternatively, or in addition, the control section 56 may cause a driving signal for a return path COM3B to include five or more of driving pulses DP1 in a section for one pixel and may set them to be a repetition unit. By supplying the driving signal for a return path COM3A or COM3B changed in this manner to the piezoelectric vibrator 30 corresponding to the nozzle 35*b* which ejects the pigment ink in the return path direction X2, as shown in the right half of FIG. 10B, in the forward path direction X1, the ejection amount of the pigment ink is large relative to the dot D2 (the right half of FIG. 10A) landed on the recording paper 6 by using the basic driving signal COM1, which is used in the return path direction X2. As a result, a difference in density between the return path direction X2 and the forward path direction X1 is reduced. Accordingly, by aligning the density of the dots D1 and D2 in the return path direction X2 with the density of the dots D1 and D2 in the forward path direction X1, a difference in density between the forward path direction X1 and the return path direction X2 is reduced.

Because the control section 56 of the printer 1 adjusts an ejection amount of at least one of the dye ink and the pigment ink by changing the driving signal COM in accordance with the landing sequence of the dye ink and the pigment ink in the recording paper 6, even if the landing sequence of inks which include different color materials differs in the forward path and the return path in the relative movement direction, density unevenness caused by a difference in infiltration rates of inks into the recording paper 6 can be reduced with a simple configuration. Consequently, deterioration of image quality of an image recorded on the recording paper 6 or the like can be prevented. For example, in one embodiment the control section 56 sets the driving signal for a forward path COM2A such that in the forward path direction X1 in which the dye ink lands after the pigment ink first lands on the recording paper 6, the ejection weight of the pigment ink is small relative to that resulting from application of the basic driving signal COM1, which is used in the return path direction X2 in which the pigment ink lands after the dye ink first lands on the recording paper 6. Alternatively, the control section 56 may set the driving signal for a return path COM3 such that in the return path direction X2, the ejection weight of the pigment ink is large relative to that resulting from application of the basic driving signal COM1, which is used in the forward path direction X1.

Since the control section 56 adjusts the ejection weight by, for example, changing the driving voltage vh of the driving pulse DP which is included in the driving signal COM which is applied to the piezoelectric vibrator 30, the ejection weight of ink can be easily adjusted.

Incidentally, the invention is not to be limited to the above-described embodiments and various modifications can be made on the basis of the statement of the claims.

In the above-described embodiments, the driving pulse DP shown in FIGS. 5, 6, 8, and 9 has been given as one example of the driving pulse in the invention. However, the shape of the pulse is not limited to the illustrated shape, and provided that a driving state of the piezoelectric vibrator 30 is variably set, a pulse of an arbitrary waveform can be used.

Also, an arrangement sequence in the main scanning direction X of the column of nozzles 39*a*, in which the nozzles 35*a* that eject the dye ink are provided in line, and the column of nozzles 39*b*, in which the nozzles 35*b* that eject the pigment ink are provided in line, may be reversed. If the position of the columns of nozzles 39*a* and 39*b* are reversed, the driving signal for a forward path COM2A may be set such that in the forward path direction X2, the ejection weight of the pigment ink is large relative to the ejection weight resulting from use of the basic driving signal COM1, which is used in the return path direction X1. Alternatively, the driving signal for a return path COM3 may be set such that in the return path direction X1, the ejection weight of the pigment ink is small relative to the ejection weight resulting from use of the basic driving signal COM1, which is used in the forward path direction X2.

In addition, in each embodiment described above, as the pressure generation section, the piezoelectric vibrator 30 of a so-called longitudinal vibration type has been illustrated. However, the pressure generation section may be embodied in other forms. For example, a piezoelectric vibrator of a so-called flexural vibration type may be used to implement the pressure generation section, in which case electric potential changes are reversed in the up-down direction in the waveforms of the driving signals illustrated in FIGS. 5, 6, 8, and 9. Also, a magnetostrictive element or a heat generation element may be used to implement the pressure generation section.

In the above description, the printer 1 is only one type of liquid ejecting apparatus. For example, principles and techniques of the invention can also be applied to other liquid ejecting apparatuses including, for example, a display manufacturing apparatus that manufactures a color filter of a liquid crystal display or the like, an electrode manufacturing apparatus that forms an electrode of an organic EL (Electro Luminescence) display, an FED (a surface-emitting display), or the like, a chip manufacturing apparatus that manufactures a biochip (a biochemical element), and the like.

The entire disclosure of Japanese Patent Application No. 2010-143788, filed Jun. 24, 2010 is expressly incorporated by reference herein.

What is claimed is:

1. A liquid ejecting apparatus comprising:

a liquid ejecting head including:

a first nozzle group having nozzles arranged in line in a direction intersecting a movement direction of the liquid ejecting head relative to a landing target, each of the nozzles in the first group of nozzles being configured to eject a first liquid that includes a dye-based color material on to a landing target; and a second nozzle group having nozzles arranged in line in parallel to the first nozzle group, each of the nozzles in the second group of nozzles being configured to eject a second liquid that includes a pigment-based color material on to the landing target;

a driving signal generation section configured to generate a driving signal that includes one or more driving pulses for driving pressure generation sections corresponding to the nozzles in the first and second nozzle groups, the pressure generation sections being configured to cause ejection of ink from the nozzles in response to being driven by the driving signal by varying the volume of pressure chambers corresponding to and in communication with the nozzles;

a scanning mechanism configured to move the landing target and the liquid ejecting head relative to each other; and an adjustment section configured to adjust an ejection weight of at least one of the first liquid and the second liquid by changing the driving signal in accordance with the landing sequence of the first liquid and the second liquid on the landing target.

2. The liquid ejecting apparatus according to claim 1, wherein the adjustment section is configured to change the driving signal such that when the scanning mechanism moves the landing target and the liquid ejecting head in a first relative movement direction, in which after the second liquid first lands on the landing target, the first liquid lands, the ejection weight of the second liquid is small relative to the ejection weight of the second liquid resulting from use of the unchanged driving signal when the scanning mechanism moves the landing target and the liquid ejecting head in a second relative movement direction, in which after the first liquid first lands on the landing target, the second liquid lands.

3. The liquid ejecting apparatus according to claim 1, wherein the adjustment section is configured to change the driving signal such that when the scanning mechanism moves the landing target and the liquid ejecting head in a first relative movement direction, in which after the first liquid first lands on the landing target, the second liquid lands, the ejection weight of the second liquid is large relative to the ejection weight of the second liquid resulting from use of the unchanged driving signal when the scanning mechanism moves the landing target and the liquid ejecting head in a second relative movement direction, in which after the second liquid first lands on the landing target, the first liquid lands.

4. The liquid ejecting apparatus according to claim 1, wherein the adjustment section adjusts the ejection weight by changing a driving voltage of the one or more driving pulses in the driving signal that is applied to the pressure generation sections.

5. The liquid ejecting apparatus according to claim 1, wherein the adjustment section adjusts the ejection weight by changing a number of the one or more driving pulses in the driving signal that is applied to the pressure generation sections.

6. A method of controlling a liquid ejecting apparatus that includes a liquid ejecting head, the method comprising:

adjusting an ejection weight of at least one of a first liquid and a second liquid by changing a driving signal in accordance with a landing sequence of the first liquid and the second liquid on a landing target;

wherein the first liquid includes a dye-based color material and is ejected by a first nozzle group having nozzles arranged in line in a direction intersecting a movement direction of the liquid ejecting head relative to the landing target, wherein the second liquid includes a pigment-based color material and is ejected by a second nozzle group having nozzles arranged in line in parallel to the first nozzle group, wherein the driving signal includes one or more driving pulses for driving pressure generation sections corresponding to the nozzles in the first and second nozzle groups, the pressure generation sections being configured to cause ejection of ink from the nozzles in response to being driven by the driving signal by varying the volume of pressure chambers corresponding to and in communication with the nozzles, and wherein the liquid ejecting head and the landing target are moved relative to each other by a scanning mechanism.

7. The method of controlling a liquid ejecting apparatus according to claim 6, wherein adjusting the ejection weight includes changing the driving signal such that when the scanning mechanism moves the landing target and the liquid ejecting head in a first relative movement direction, in which after the second liquid first lands on the landing target, the first liquid lands, the ejection weight of the second liquid is small relative to the ejection weight of the second liquid resulting from use of the unchanged driving signal in a second relative movement direction, in which after the first liquid first lands on the landing target, the second liquid lands.

8. The method of controlling a liquid ejecting apparatus according to claim 6, wherein adjusting the ejection weight includes changing the driving signal such that when the scanning mechanism moves the landing target and the liquid ejecting head in a first relative movement direction, in which after the first liquid first lands on the landing target, the second liquid lands, the ejection weight of the second liquid is large relative to the ejection weight of the second liquid resulting from use of the unchanged driving signal when the scanning mechanism moves the landing target and the liquid ejecting head in a second relative movement direction, in which after the second liquid first lands on the landing target, the first liquid lands.

9. The method of controlling a liquid ejecting apparatus according to claim 6, wherein adjusting the ejection weight includes changing a driving voltage of the one or more driving pulses in the driving signal that is applied to the pressure generation section.

10. The method of controlling a liquid ejecting apparatus according to claim 6, wherein adjusting the ejection weight includes changing a number of the one or more driving pulses in the driving signal that is applied to the pressure generation section.

* * * * *